United States Patent [19]

Shinkai

[11] Patent Number: 4,523,262

[45] Date of Patent: Jun. 11, 1985

[54] HEADLIGHT FOR AN AUTOMOTIVE VEHICLE

[75] Inventor: Hiroaki Shinkai, Susono, Japan

[73] Assignee: Toyota Jidosha Kabushiki Kaisha, Toyota, Japan

[21] Appl. No.: 428,193

[22] Filed: Sep. 29, 1982

[30] Foreign Application Priority Data

Oct. 5, 1981 [JP] Japan ..... 56-148576[U]

[51] Int. Cl.[3] ..... F21M 3/14

[52] U.S. Cl. ..... 362/214; 362/61; 362/80; 362/83; 362/211; 362/301; 362/307; 362/311; 362/296

[58] Field of Search ..... 362/61, 80, 83, 211, 362/214, 215, 257, 296, 299, 326, 332, 328, 301, 341, 347, 349, 351, 346, 339, 307, 308, 311, 336

[56] References Cited

U.S. PATENT DOCUMENTS

| | | | |
|---|---|---|---|
| 981,290 | 1/1911 | Lebby | 362/347 |
| 1,625,946 | 4/1927 | Laird | 362/346 |
| 1,835,745 | 12/1931 | Barbian | 362/ |
| 2,012,806 | 2/1933 | Brown | 362/328 |
| 2,154,842 | 4/1939 | Glenn | 362/346 |
| 3,539,799 | 11/1970 | Dangauthier | 362/328 |
| 4,261,031 | 4/1981 | Fratty | 362/336 |
| 4,276,583 | 6/1981 | Fratty | 362/346 |

FOREIGN PATENT DOCUMENTS

| | | | |
|---|---|---|---|
| 684841 | 7/1930 | France | 362/308 |
| 69482 | 3/1956 | France | 362/347 |
| 592932 | 5/1959 | Italy | 362/211 |
| 656948 | 10/1963 | Italy | 362/ |
| 292167 | 6/1928 | United Kingdom | 362/215 |
| 372285 | 5/1932 | United Kingdom | 362/309 |
| 2069123 | 8/1981 | United Kingdom | 362/346 |

*Primary Examiner*—Donald P. Walsh
*Assistant Examiner*—David Cornwell
*Attorney, Agent, or Firm*—Kenyon & Kenyon

[57] ABSTRACT

A headlight for an automotive vehicle has a reflector formed substantially in a semicircular shape above the optical axis of the headlight so as to serve as its reflective portion and an upper portion of the reflector extends forwardly from the reflective portion to serve as a light shielding portion. Another light shielding portion is provided below a lamp bulb, which is included in the headlight, and is arranged substantially in parallel relation with the optical axis. An upper lens element of the lens of the headlight has a cross section determined in such a manner that the rays of light incident upon the upper lens element from the reflective portion of the reflector are downwardly refracted, and the vertical dimension of a lower lens element of the lens of the headlight is reduced as compared with a conventional headlight.

2 Claims, 10 Drawing Figures

HEADLIGHT FOR AN AUTOMOTIVE VEHICLE

BACKGROUND OF THE INVENTION

This invention relates to a headlight for an automotive vehicle.

In recent years, it has been an important problem to improve aerodynamic characteristics of an automotive vehicle, in order to reduce fuel consumption in the automotive vehicle. To meet such requirements, it has been considered to be significantly effective to design the front portion of engine hood as a downwardly slanting nose. However, a headlight has limitations for the above-mentioned measures to be applied because of its conventional shape and size. For this reason, it has been a long-felt want to reduce the size of headlights.

Furthermore, an easy-going way of attempting to minimize the size of headlights reduces beam performance of headlights. Even if a good beam performance is attained with such a small headlight, it is not well applicable as a headlight so long as it is likely to spoil the beauty of an automotive design.

SUMMARY OF THE INVENTION

Accordingly, it is a primary object of the present invention to provide a headlight for an automotive vehicle which may lead to reduced size without impairing its beam performance and spoiling the beauty of its design.

It is another object of the present invention to decrease the vertical dimension of a headlight without reducing the performance of a low beam which is quite frequently used.

It is a further object of the present invention to reduce the size of a headlight without varying light distribution of low beam which is frequently used and without impairing lighting performance when main beam is used.

It is still a further object of the present invention to improve aerodynamic characteristics of an automotive vehicle by reducing the size of a headlight and slanting the front portion of an engine hood.

According to the invention, a lens is provided at the front opening of a reflector, and the lens is composed of an upper lens element, a middle upper lens element, a middle lens element including a right member, a left member, and a central member, and a lower lens element. The upper lens element has a cross-sectioned shape such that it may downwardly refract the rays of light incident thereupon more than a conventional lens element. The shapes of the cross sections of the middle upper lens and the middle lens are substantially identical with those of a conventional lens.

Another feature of the present invention is that a vertical dimension of a lower lens element of a lens is reduced and the resultant deficiency in light distribution of a main beam in a lower direction is designed to be compensated by an upper lens element of the lens.

Various general and specific objects, advantages and aspects of the invention will become apparent when reference is made to the following detailed description of the invention considered in conjunction with the related accompanying drawings.

BRIEF DESCRIPTION OF THE DRAWINGS

FIG. 9(*b*) is a cross-sectional view taken along the line IX(*b*)—IX(*b*) of FIG. 8;

FIG. 10(*b*) is an illustrative view of a light distribution of main beam.

DETAILED DESCRIPTION OF THE PREFERRED EMBODIMENT

Figure 1:
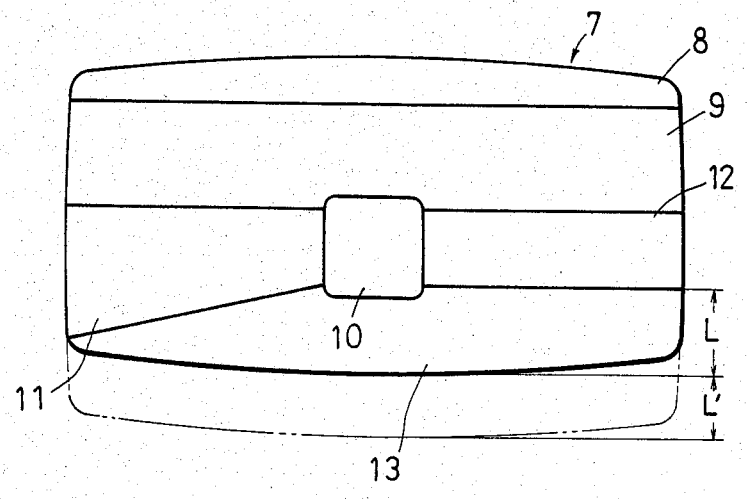
FIG. 1 is a front elevational view of a lens of a headlight according to the preferred embodiment of the present invention.

Referring now to FIGS. 1 through 4 which show a preferred embodiment of the invention, reference numeral 1 designates a headlight for an automotive vehicle, and a reflector 2 is mounted to an automotive body (not shown) at a predetermined position. A lamp bulb 3 is arranged on the optical axis A of the reflector 2. The lamp bulb 3 includes a main-beam filament 4, a low-beam filament 5 and a shade plate 6 therein. The reflector 2 is composed of a semicircular reflective portion 2*a* formed on the upper side of the optical axis A of the reflector 2, a light shielding portion extending forwardly from the front end of the reflective portion 2*a* and another light shielding portion 2*c* arranged adjacent to and below the lamp bulb 3 and in parallel relation with the optical axis A. The mainbeam filament 4 is positioned in the vicinity of the focus F of the reflector 2. Light emitted from the filament 4 is reflected by the reflector 2, and then the rays of light advance substantially in parallel relation with the optical axis A. The low-beam filament 5 is positioned on the front side of the focus F. Light emitted from the filament 5 is reflected by the reflective portion 2*a* of the reflector 2 and then the rays of light advance downwardly at an angle to the optical axis A. A shade plate 6 is provided within the lamp bulb 3 and below the low-beam filament 5 for shielding the rays of light advancing downwardly from the low-beam filament 5.

A lens 7 is provided at the front opening of the reflector 2 and, as shown in FIG. 1, the lens 7 is composed of an upper lens element 8, a middle upper lens element 9, a middle lens element including a right member 11 and a left member 12 and a central member 10, and a lower lens element 13. Vertical dimension L of the lower lens element 13 is smaller by the vertical dimension L′ as compared with a conventional lens. As a result, the lower portion of the reflector 2 may be cut away by the size corresponding to the dimension L′ as indicated by a phantom line in FIGS. 2 and 3, and the headlight 1 may be made smaller than that in the prior art.

The upper lens element 8 is so formed as to compensate for deficiency in light distribution of the main beam in the lower direction, which deficiency results from decrease in the vertical dimension of the lower lens element 13. The cross-sectional shape of the upper lens element 8 is determined to downwardly refract the rays of light incident upon the upper lens element 8 more than a conventional lens. The upper middle element 9 and the middle lens elements 10, 11 and 12 are substantially identical with a conventional lens.

Figure 2:
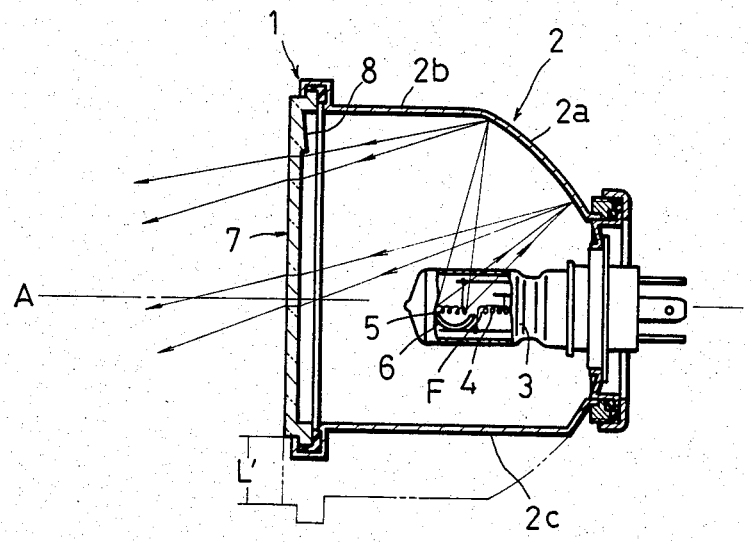
FIG. 2 is a vertical sectional side view of a headlight, illustrating a light path of low beam.

In operation, when the low-beam filament 5 is used as shown in FIG. 2, the downwardly advancing rays of the light emitted from the low-beam filament 5 are shielded by the shade plate 6 and the upwardly advancing rays of the light are reflected by the reflective portion 2*a* of the reflector 2. The reflected light advances downwardly and forwardly to the middle upper lens element 9 and the middle lens element 11 and 12 and then penetrates such lens elements, thus obtaining the light distribution of the low beam substantially similar to that of a conventional headlight.

Figure 3:
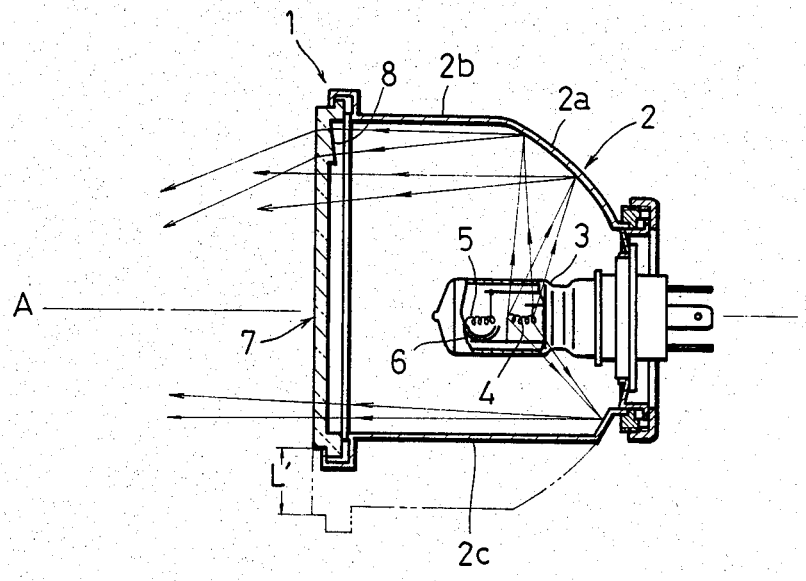
FIG. 3 is a vertical sectional side view of a headlight, illustrating a light path of main beam.
Figure 4:
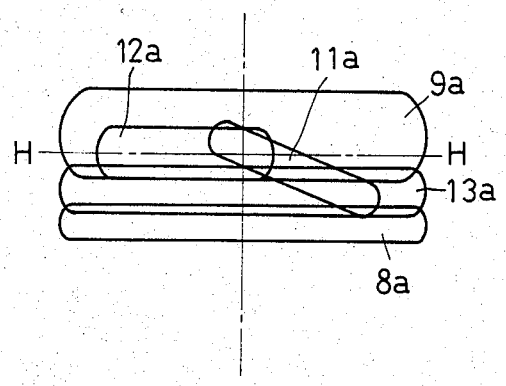
FIG. 4 is an illustrative view of a light distribution of main beam.

When the main-beam filament 4 is used as shown in FIG. 3, the light emitted from the main-beam filament 4 is reflected by the reflector 2 and then advances substantially in parallel relation with the optical axis A to each lens element 8, 9, 11, 12 and 13 of the lens 7 and penetrates such lens elements to obtain the corresponding light distributions 8*a*, 9*a*, 11*a*, 12*a*, and 13*a* of the main beam as shown in FIG. 4. It will be noted that the rays of light penetrating the upper lens element 8 advance downwardly or at an angle to the optical axis A, such that the light distribution 8*a* fills in the lower portion of light distribution 13*a* from the lower lens element 13. Thus, the distributions are different from those from a conventional headlight. That is to say, the deficiency in the light distribution 13*a* of a main beam in the lower direction from a horizontal surface H—H due to decrease in the vertical dimension of the lower lens element 13 may be compensated by the light distribution 8*a* from the upper lens element 8.

Figure 5:
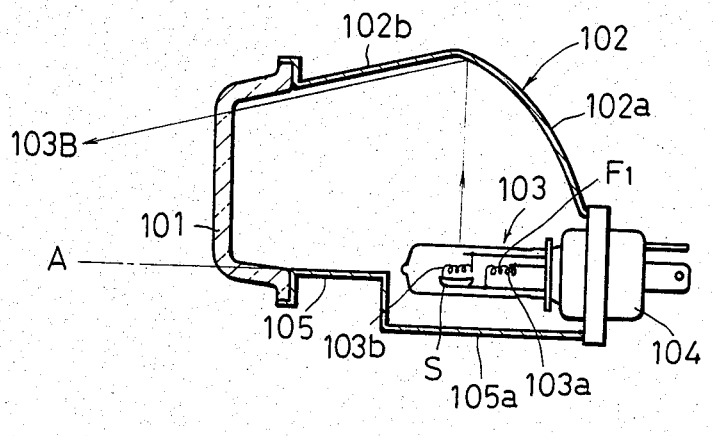
FIG. 5 is a vertical sectional side view of a headlight according to the second preferred embodiment of the present invention.

Referring next to FIG. 5 which shows a second preferred embodiment of the invention, a reflector 102 with a lens 101 at its front opening includes a lamp bulb 103 arranged on its optical axis A. In the lamp bulb 103, a main-beam filament 103*a* is positioned at the focus $F_1$ of the reflector 102 and a low-beam filament 103*b* is positioned on the front side of the focus $F_1$. A shade plate S is preferably provided below the low-beam filament 103*b*, which may be omitted as desired.

The reflector 102 is composed of a semicircular reflective portion 102*a* extending upwardly from a retainer 104 for the lamp bulb 103 to the upright portion directly above the low-beam filament 103*b* and a light shielding portion 102*b* extending downwardly or in a slantwise manner from the upper end of the reflective portion 102*a* to the lens 101. The angle of inclination of the light shielding portion 102*b* is determined in such a manner that the rays of the reflected light 103b reflected at the upright portion directly above the low-beam filament 103*b* are substantially in parallel relation with the inner surface of the light shielding portion 102*b*.

The lower portion of the reflector 102 is formed to a light shielding portion 105 which has a semicylindrical recess 105*a* adjacent to and below the lamp bulb 103. The lens 101 is fixed to the front end of the light shielding portion 102*b* and to the front end of the light shielding portion 105 by any suitable means such as bonding means.

In operation, when the low-beam filament 103*b* is used as shown in FIG. 5, the rays of light upwardly emitted from the low-beam filament 103*b* are reflected by the reflective portion 102*a* of the reflector 102 and then advances downwardly or at an angle to the optical axis A toward and through the lens 101 in such a way that the reflected light 103B is in parallel relation with the inner surface of the light shielding portion 102*b* of the reflector 102. On the other hand, the rays of light downwardly emitted from the low-beam filament 103*b* are shielded by the shade plate S. In the case that the shade plate S is not provided, the rays of light are shielded by the recess 105*a* of the light shielding portion 105.

When the main-beam filament 103*a* is used, the rays of light upwardly emitted from the main-beam filament 103*a* are reflected by the reflective portion 102*a* of the reflector 102 and then advances in parallel relation with the optical axis A toward and through the lens 101. The rays of light downwardly emitted from the main-beam filament 103*a* are shielded by the recess 105*a* of the light shielding portion 105.

According to the second preferred embodiment, since the vertical dimension of the headlight may be decreased without reducing the performance of the low beam which is quiet frequently used, the aerodynamic characteristic of an automotive vehicle may be remarkably improved, thereby reducing fuel consumption.

Figure 6:
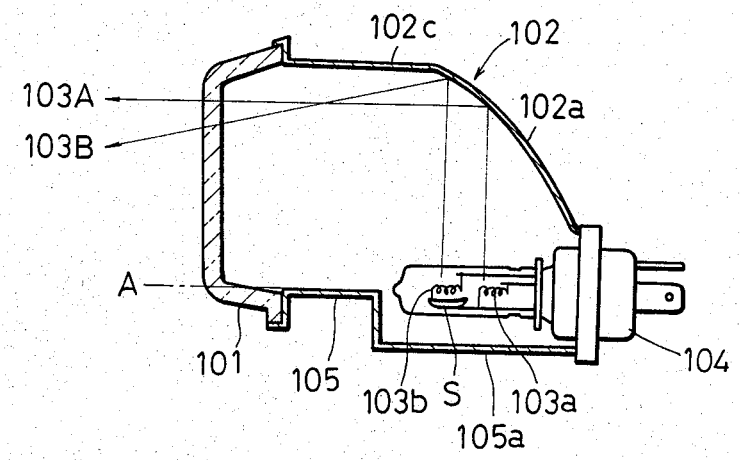
FIG. 6 is a vertical sectional side view of a headlight according to the third preferred embodiment of the present invention.

Referring next to FIG. 6 which shows a third preferred embodiment, a light shielding portion 102*c* is arranged substantially in parallel relation with the optical axis A. Accordingly, the main beam 103A is not influenced by decrease in the vertical dimension of the headlight.

As any other constitution and operation are similar to those of the second preferred embodiment, like elements are indicated by like reference numerals and the explanation thereof will be omitted.

Figure 7:
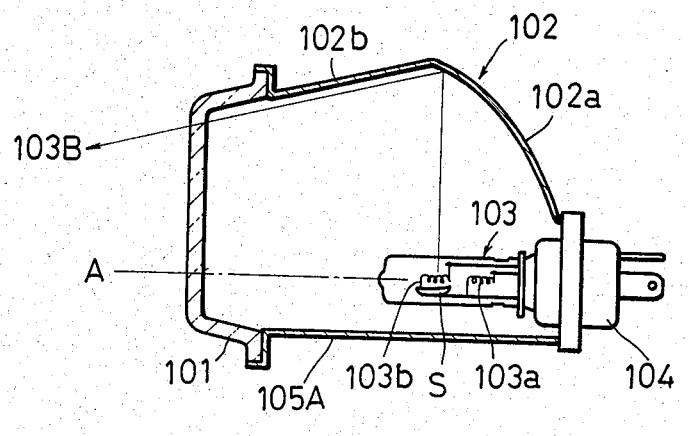
FIG. 7 is a vertical sectional side view of a headlight according to the fourth preferred embodiment of the present invention.

Referring next to FIG. 7 which shows a fourth preferred embodiment, a light shielding portion 105A is arranged adjacent to and below the lamp bulb 103 and substantially in parallel relation with the optical axis A without providing the recess 105*a* as in FIGS. 5 and 6. Accordingly, this embodiment is more advantageous as far as costs are concerned as compared with the second and the third preferred embodiments.

As any other constitution and operation are similar to those of the second preferred embodiment, like elements are indicated by like reference numerals and the explanation thereof will be omitted.

Figure 8:
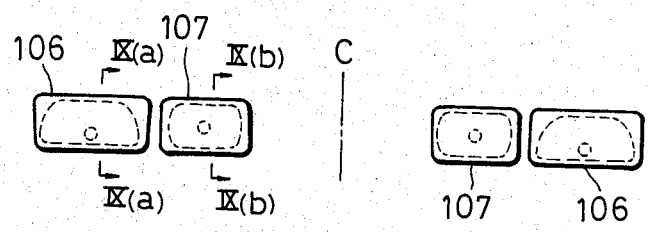
FIG. 8 is a front elevational view of a headlight unit according to the fifth preferred embodiment of the present invention.
Figure 9:
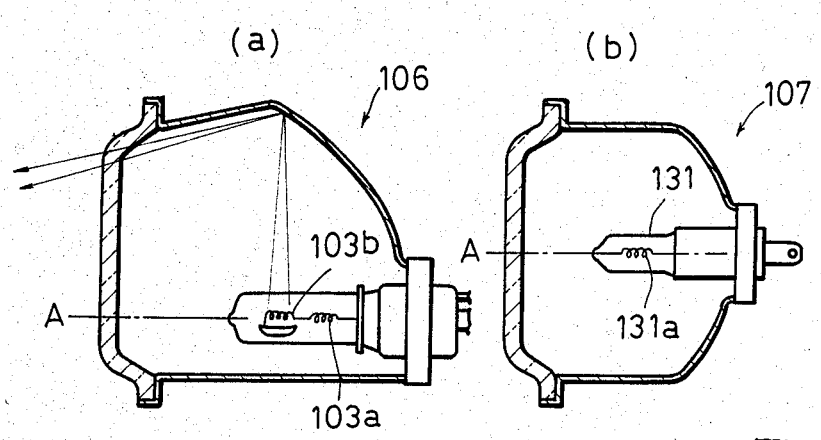
FIG. 9(*a*) is a cross-sectional view taken along the line IX(*a*)—IX(*a*) of FIG. 8.
Figure 10:
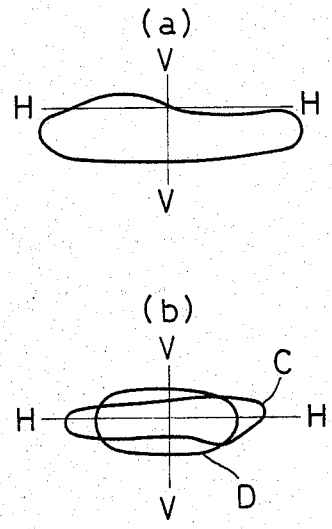
FIG. 10(*a*) is an illustrative view of a light distribution of low beam.

Referring next to FIGS. 8 through 10 which show a fifth preferred embodiment, outside headlights 106 of a four-lamp type are employed for the headlight as shown in FIG. 9*a* which is disclosed in the second to the fourth preferred embodiments and inside headlights 107 are employed for the headlight as shown in FIG. 9*b* wherein a lamp bulb 131 including only a main-beam filament 131*a* and the vertical dimension of the headlight is similar to that of the outside headlights 106. With this arrangement, when low beam is used, the low-beam filament 103*b* of the outside headlight emits the rays of light, and a light distribution as shown in FIG. 10*a* may be obtained. On the other hand, when main beam is used, the main-beam filament 103*a* of the outside headlight 106 and another main-beam filament 131*a* of the inside headlight 107 emit the rays or light, and light distributions as shown in FIG. 10*b* may be obtained, in which a symbol C indicates a light distribution of the outside headlights 106 and a symbol D indicates a light distribution of the inside headlights 107. In such a case that a four-lamp type is employed as a headlight, the vertical dimension of the headlight may be decreased and aerodynamic characteristics of an automotive vehicle may be improved.

In the second to the fifth preferred embodiments, the lens 7 of the first preferred embodiment may be employed as a matter of course. Although in the preceding preferred embodiments, a semi-sealed beam headlight unit is employed, an open type unit or a sealed beam headlight unit may be likewise employed.

Having thus described the preferred embodiments of the invention it should be understood that numerous structural modifications and adaptations may be restored to without departing from the spirit of the invention.

What is claimed is:

1. A headlight for an automotive vehicle, the headlight comprising a concave reflector having a focusing portion, with an optical axis and a focus on said optical axis, and a front opening, a main-beam lamp filament positioned in the vicinity of said focus on said optical axis, a low-beam filament positioned on the front side of said main-beam filament, and a lens mounted in the front opening of the reflector, wherein said lens comprises an upper lens element, an upper middle lens element arranged just below said upper lens element, a middle lens element arranged just below said upper middle lens element and consisting of a right lens member, a central lens member, and a left lens member, and a lower lens element arranged just below said middle lens element, the vertical dimension of said lens below the optical axis being substantially less than the vertical dimension of said lens above the optical axis, and said upper lens element having a cross-sectional shape in elevation such that light rays from the main-beam filament that are incident thereon after reflection by the concave reflector are refracted downwardly to provide a light distribution pattern from said upper lens element that crosses, and fills in below, the light distribution patterns from said upper middle, middle, and lower lens elements under main-beam operation of the headlight.

2. A headlight according to claim 1 wherein the thickness of said upper lens element gradually increases from top to bottom of said upper lens element.

* * * * *